US012599802B2

(12) United States Patent
Wang et al.

(10) Patent No.: US 12,599,802 B2
(45) Date of Patent: Apr. 14, 2026

(54) TRAINING MECHANISM AND ROBOT FOR WATER-BASED LOWER-LIMB REHABILITATION

(71) Applicant: Fudan University, Shanghai (CN)

(72) Inventors: Hongbo Wang, Shanghai (CN); Yongfei Feng, Shanghai (CN); Xusheng Wang, Shanghai (CN); Jianye Niu, Shanghai (CN); Hao Yan, Shanghai (CN); Yao Yu, Shanghai (CN); Jingjing Luo, Shanghai (CN); Shijie Guo, Shanghai (CN)

(73) Assignee: Fudan University, Shanghai (CN)

( * ) Notice: Subject to any disclaimer, the term of this patent is extended or adjusted under 35 U.S.C. 154(b) by 501 days.

(21) Appl. No.: 18/358,126

(22) Filed: Jul. 25, 2023

(65) Prior Publication Data

US 2024/0017114 A1 Jan. 18, 2024

(30) Foreign Application Priority Data

Oct. 12, 2022 (CN) ..... 202211245080.8

(51) Int. Cl.

| | |
|---|---|
| ***A63B 21/00*** | (2006.01) |
| ***A61G 7/10*** | (2006.01) |
| ***A61H 1/02*** | (2006.01) |

(52) U.S. Cl.

CPC ..... *A63B 21/00181* (2013.01); *A63B 21/152* (2013.01); *A63B 21/4029* (2015.10); *A63B 2208/03* (2013.01)

(58) Field of Classification Search

CPC ..... A63B 21/00181; A63B 21/152; A63B 2208/03; A61H 2201/0115; A61H 2201/1642; A61H 1/0262; A61H 3/00; A61G 7/1005; A61G 7/1003

See application file for complete search history.

(56) References Cited

U.S. PATENT DOCUMENTS

| | | | | |
|---|---|---|---|---|
| 6,966,885 | B2 * | 11/2005 | Osipov | A61H 1/0229 482/111 |
| 2005/0054964 | A1 * | 3/2005 | Osipov | A61G 7/103 602/32 |
| 2013/0312174 | A1 * | 11/2013 | Kanetis | A61G 7/1074 4/496 |

FOREIGN PATENT DOCUMENTS

| | | |
|---|---|---|
| CN | 112370305 A | 2/2021 |
| CN | 114367080 B | 7/2022 |

* cited by examiner

*Primary Examiner* — Kristen C Hayes

(57) ABSTRACT

A training mechanism for water-based lower-limb rehabilitation, including two leg training sub-mechanisms. Each leg training sub-mechanism includes a hip joint training device, an adjustable thigh plate, an adjustable shank plate, a knee training device, an ankle training device and a pedal. The hip joint training device, knee training device and ankle training device are connected to a remote control motor box through a Bowden cable assembly, respectively. A robot including the training mechanism is also provided, whose power source is arranged outside the water, and the power is supplied to the training mechanism through the Bowden cable assembly.

10 Claims, 10 Drawing Sheets

TRAINING MECHANISM AND ROBOT FOR WATER-BASED LOWER-LIMB REHABILITATION

CROSS-REFERENCE TO RELATED APPLICATIONS

This application claims the benefit of priority from Chinese Patent Application No. 202211245080.8, filed on Oct. 12, 2022. The content of the aforementioned application, including any intervening amendments thereto, is incorporated herein by reference in its entirety.

TECHNICAL FIELD

The present disclosure relates to medical devices, and more particular to a training mechanism and robot for water-based lower-limb rehabilitation.

BACKGROUND

Underwater-based rehabilitation is a novel rehabilitation training strategy that has emerged in recent years, which makes full use of the natural characteristics of water and the biochemical and physical reaction in water. Compared with the traditional land-based rehabilitation means, water can provide buoyancy to prevent secondary injury caused by abnormal muscle strength, limited balance ability and poor joint stability. Moreover, water can be heated according to the patient's needs to improve the metabolism and blood circulation, significantly shortening the rehabilitation cycle. Whereas, regarding the existing water-based rehabilitation strategies, considering that the patients need to be exposed to water for a long time, and the land-based rehabilitation facilities fail to be directly applied to the underwater environment, it generally requires a rehabilitation therapist to stay in the hydrotherapy pool to assist the patient to complete the rehabilitation training, which will result in excessive labor intensity and physical discomfort to the therapist.

Furthermore, the underwater rehabilitation facilities require a water-proof power source, which leads to a high cost. Under the complex fluid environment, the rehabilitation facilities have limited sensitivity, and is prone to disturbance from complex water pressure, thus affecting the rehabilitation efficiency.

SUMMARY

To overcome the defects, such as high cost and low sensitivity, in the prior art, the present disclosure provides a training mechanism for water-based rehabilitation, whose power source is arranged outside the water (the water-proof treatment is not needed), allowing for low cost. Moreover, the training mechanism also possesses high sensitivity.

Technical solutions of the disclosure are described as follows.

In a first aspect, the disclosure provides a training mechanism for water-based lower-limb rehabilitation, comprising:

a remote control motor box;

a support plate;

a sliding table-rod assembly;

a hanging frame; and two leg training sub-mechanisms;

wherein the remote control motor box is arranged at a portion of a wall of a water tank which is not in contact with water, or arranged at a platform away from water; the support plate is configured for patient's buttocks to lean on; the sliding table-rod assembly is fixedly arranged on a position of the support plate corresponding to patient's back; the hanging frame is arranged at an end of the sliding table-rod assembly away from patient's body, and is configured to be located under patient's arms; and the two leg training sub-mechanisms are symmetrically arranged at two sides of the support plate, and are configured for training of the patient's legs;

each of the two leg training sub-mechanisms comprises a hip joint training device, an adjustable thigh plate, an adjustable shank plate, a knee training device, an ankle training device and a pedal; and the hip joint training device, the knee training device and the ankle training device are connected to the remote control motor box through a Bowden cable assembly, respectively; and the Bowden cable assembly comprises a first driving wheel, two first guide wheels matching the first driving wheel and two first Bowden cables; first ends of the two first Bowden cables are connected to output shafts of two motors in the remote control motor box, respectively; and a second end of one of the two first Bowden cables is configured to wind around one of the two first guide wheels to be fixed to a first side of the first driving wheel, and a second end of the other of the two first Bowden cables is configured to wind around the other of the two first guide wheels to be fixed to a second side of the first driving wheel; and the two first Bowden cables are configured to drive the first driving wheel to rotate along a rotation axis of the first driving wheel.

In some embodiments, the hip joint training device further comprises a mounting plate, the adjustable thigh plate, a first telescopic guide rod and a second telescopic guide rod;

the mounting plate is clampedly arranged at a lower end surface of the support plate;

the adjustable thigh plate is rotatably arranged on the mounting plate through a Hooke hinge;

an end of the first telescopic guide rod is rotatably arranged at an outer side of the adjustable thigh plate; and an end of the second telescopic guide rod is rotatably arranged at a rear side of the adjustable thigh plate.

In some embodiments, the knee training device comprises a second driving wheel and two second guide wheels;

the second driving wheel is arranged on the adjustable thigh plate; the two second guide wheels are arranged side by side on the adjustable thigh plate and above the second driving wheel; the second driving wheel is coaxial with the adjustable shank plate; and a first side of the second driving wheel is fixedly provided with one of two second Bowden cables, and a second side of the second driving wheel is fixedly provided with the other of the two second Bowden cables; and the two second Bowden cables are configured to crosswise wind around the two second guide wheels, and connected to output ends of the two motors.

In some embodiments, the ankle training device comprises a first ankle training assembly, a second ankle training assembly and a third ankle training assembly; the first ankle training assembly is configured for ankle flexion and extension; the second ankle training assembly is configured for ankle inversion and eversion; and the third ankle training assembly is configured for ankle abduction and adduction;

the first ankle training assembly comprises a second driving wheel, two second guide wheels and an ankle support frame; the second driving wheel is arranged on the adjustable shank plate; the two second guide wheels are arranged side by side on the adjustable shank plate and above the second driving wheel; the ankle support frame is connected to the pedal; the ankle support frame is coaxial with the second driving wheel; a first side of the second driving wheel is fixedly provided with one of two second Bowden cables, and a second side of the second driving wheel is fixedly provided with the other of the two second Bowden cables; the two second Bowden cables are configured to crosswise wind around the two second guide wheels, and connected to output ends of the two motors, respectively;

the second ankle training assembly comprises a connecting part, a third driving wheel and two third guide wheels; the connecting part is rotatably arranged on the ankle support frame; the third driving wheel is arranged on a vertical bar of the ankle support frame; the two third guide wheels are arranged side by side on the vertical bar and below the third driving wheel; the connecting part is coaxial with the third driving wheel; a first side of the third driving wheel is fixedly provided with one of two third Bowden cables, and a second side of the third driving wheel is fixedly provided with the other of the two third Bowden cables; the two third Bowden cables are configured to crosswise wind around the two third guide wheels, and are connected to output ends of the two motors, respectively; and the third ankle training assembly comprises a fourth driving wheel and two fourth guide wheels; the fourth driving wheel is arranged on a bottom plate of the connecting part; the two fourth guide wheels are arranged side by side on a bottom plate of the ankle support frame, and outside the fourth driving wheel; the fourth driving wheel is coaxial with the connecting part; a first side of the fourth driving wheel is fixedly provided with one of two fourth Bowden cables, and a second side of the fourth driving wheel is fixedly provided with the other of the two fourth Bowden cables; the two fourth Bowden cables are configured to crosswise wind around the two fourth guide wheels, and are connected to output ends of the two motors, respectively.

In some embodiments, the pedal is rotatably connected to a vertical plate of the connecting part.

In some embodiments, the adjustable shank plate comprises a shank fixing plate and a shank sliding plate;

the shank fixing plate is connected to the knee training device; and the shank sliding plate is slidably connected to the shank fixing plate; and the second driving wheel and the two second guide wheels are arranged on the shank sliding plate.

In some embodiments, the adjustable thigh plate comprises a thigh fixing plate, a thigh sliding plate and a fastening knob;

the thigh fixing plate is rotatably mounted at the mounting plate; the thigh sliding plate is slidably connected to the thigh fixing plate in the vertical direction; and the fastening knob is configured to fix the thigh fixing plate and the thigh sliding plate; and the second driving wheel and the two second guide wheels are mounted on the thigh fixing plate.

In a second aspect, the disclosure provides a robot for water-based lower-limb rehabilitation, comprising:

the above-mentioned training mechanism;

a water tank; and a control platform;

wherein the water tank is configured to accommodate water; and the control platform is configured to control the training mechanism;

the training mechanism is rotatably connected to an upper end of the water tank through a rotating mechanism; the training mechanism is configured to rotate to an outside of the water tank when the patient is allowed to wear the training mechanism, and to rotate to an inside of the water tank to allow the patient to undergo rehabilitation training; and the remote control motor box is arranged on an inner wall of the water tank and is not in contact with the water inside the water tank.

In some embodiments, the rotating mechanism comprises a rotation hole, a rotating support rod and a fixing rod;

the rotation hole is provided at the upper end of the water tank; the rotating support rod is rotatably arranged at the rotation hole; and the fixing rod is arranged on the rotating support rod; and the fixing rod is perpendicular to a main rod body of the rotating support rod; the sliding table-rod assembly is rotatably arranged on the fixing rod; and the sliding table-rod assembly is parallel to the main rod body of the rotating support rod.

In some embodiments, the robot further comprises a lower-limb support mechanism;

wherein the lower-limb support mechanism is arranged at the upper end of the water tank, and is opposite to the rotation hole; and the lower-limb support mechanism is configured to support an end of the fixing rod away from the rotating support rod;

the lower-limb support mechanism comprises a support sleeve and a telescopic rod; the support sleeve is fixedly arranged at the upper end of the water tank; and the telescopic rod is sleevedly provided inside the support sleeve; and an end of the telescopic rod away from the water tank is provided with a groove; the groove is configured to receive the fixing rod; and a height of the telescopic rod inside the support sleeve is adjustable.

Compared to the prior art, this application has the following beneficial effects.

(1) Regarding the robot designed herein, the power source is arranged outside the water, and the power is supplied to the underwater training mechanism through a Bowden cable assembly. Therefore, it is not required to perform waterproofing treatment on the power source or add an additional waterproofing device. Moreover, the robot can realize the six-degree-of-freedom (6-DOF) training including hip abduction and adduction, hip flexion and extension, knee flexion and extension, ankle flexion and extension, ankle inversion and eversion and ankle abduction and adduction. Therefore, the robot has excellent flexibility and low cost.

(2) This application adopts a Bowden cable assembly for power transmission. First ends of the two Bowden cables are connected to two motor output shafts, respectively, and second ends of the two Bowden cables are wound around two guide wheels and respectively fixed to two sides of the driving wheel. The Bowden cables are configured to drive the driving wheel to rotate, so as to perform the 6-DOF lower-limb rehabilitation training. It not only overcomes the under-actuation of the rehabilitation mechanism in the complex fluid, but also effectively enhances the sensitivity of the robot in the presence of interference to the power source and power transmission in a complex fluid environment.

(3) The training mechanism is rotatably mounted at an upper end of the water tank, such that it can rotate freely in a preset angle range with respect to the water tank. When the patient is allowed to wear the training mechanism, the training mechanism is rotated to the outside of the water tank, and when the patient needs underwater training, the training mechanism is rotated to the inside of the water tank. In this way, it is not necessary for the medical worker to enter the water to help the patient wear the training mechanism. In addition, the training mechanism can be adjusted outside the water tank according to the patient's height, facilitating the wearing operation. By means of the rotating mechanism, the medical worker does not require to enter the water to help the patient to wear the training mechanism, exhibiting excellent practical applicability.

(4) The robot provided herein can be used to independently train patient's hip, knee or ankle, and can also realize the synergistic and coordinated training of multiple joints, allowing for improved man-machine compatibility and comfortability.

BRIEF DESCRIPTION OF THE DRAWINGS

In order to explain the technical solutions of the present disclosure more clearly, the accompanying drawings needed in the description of embodiments of the present disclosure will be briefly described below.

Figure 1:
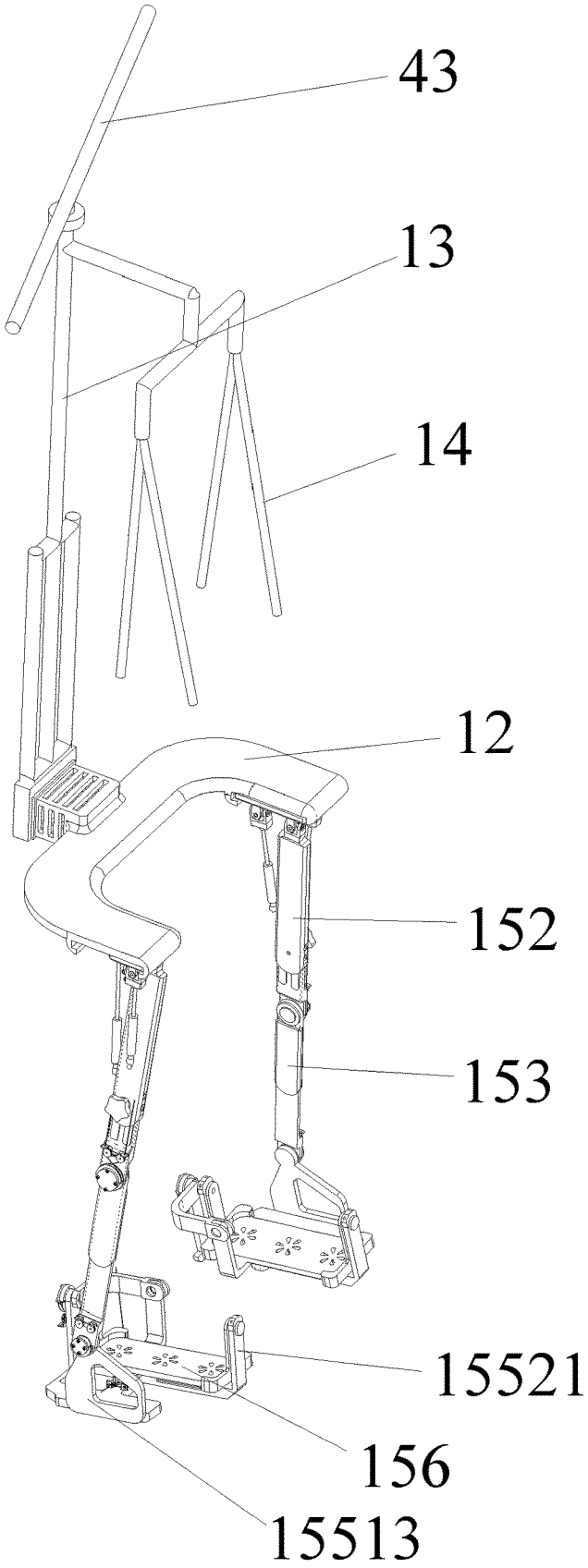
FIG. 1 is a first perspective view of a training mechanism according to Embodiment 1 of the present disclosure.
Figure 2:
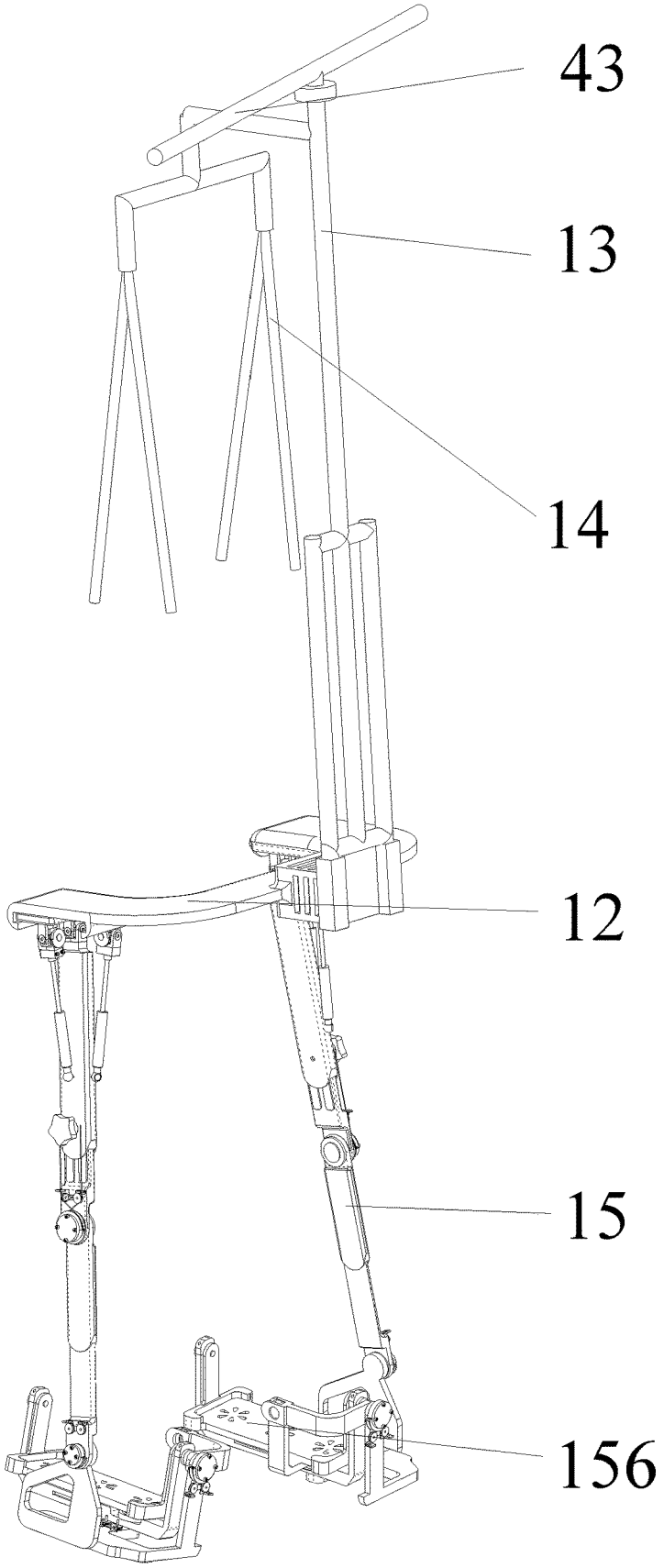
FIG. 2 is a second perspective view of the training mechanism according to Embodiment 1 of the present disclosure.
Figure 3:
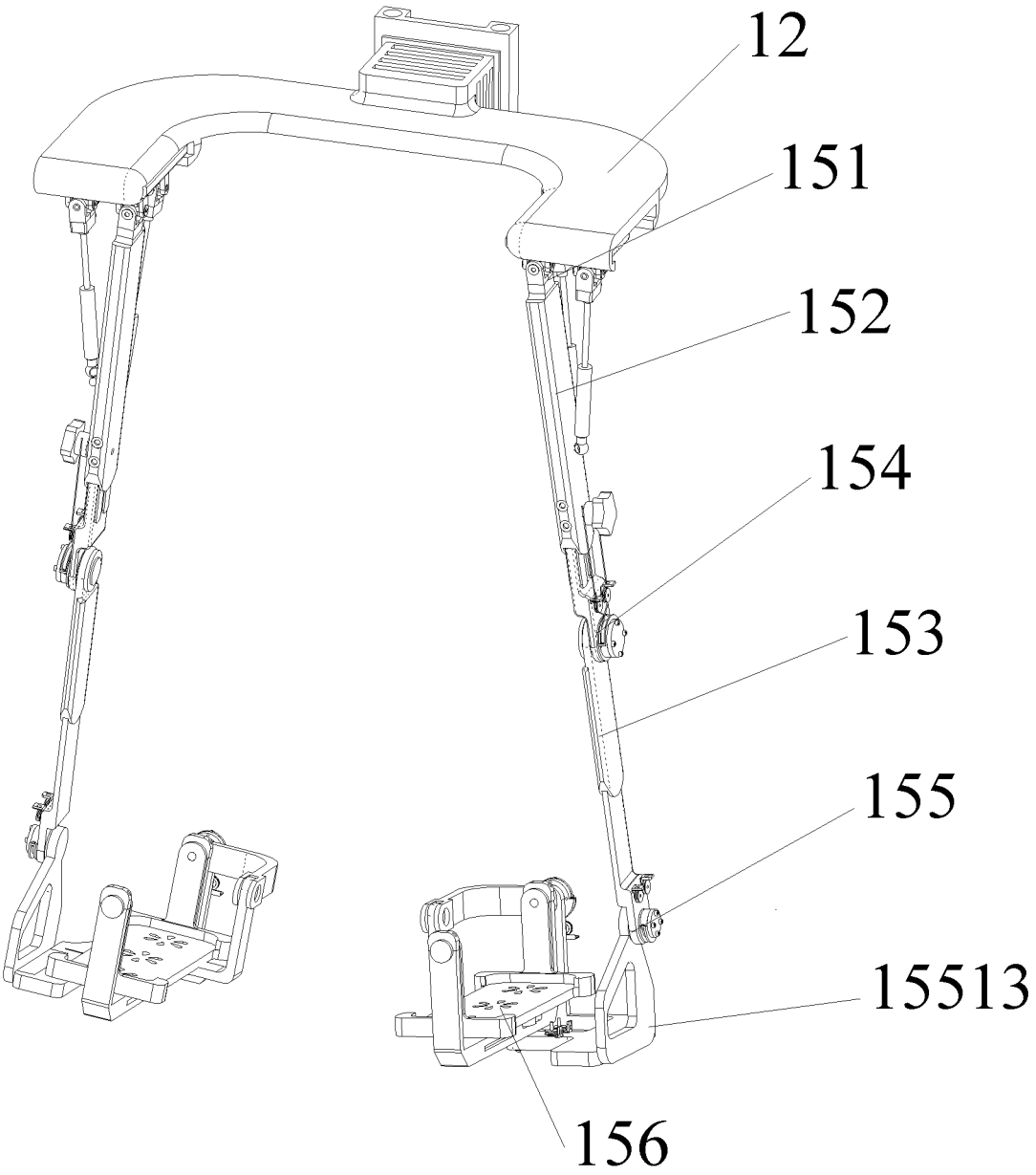
FIG. 3 partially depicts a structure of the training mechanism according to Embodiment 1 of the present disclosure.

In the drawings, 1, training mechanism; 11, remote control motor box; 12, support plate; 13, sliding table-rod assembly; 14, hanging frame; 15, leg training sub-mechanism; 151, hip joint training device; 1511, mounting plate; 1512, Hooke hinge; 1513, first telescopic guide rod; 1514, second telescopic guide rod; 152, adjustable thigh plate; 1521, thigh fixing plate; 1522, thigh sliding plate; 1523, fastening knob; 153, adjustable shank plate; 1531, shank fixing plate; 1532, shank sliding plate; 154, knee training device; 1541, first driving wheel; 1542, first guide wheel; 155, ankle training device; 1551, first ankle training assembly; 15511, second driving wheel; 15512, second guide wheel; 15513, ankle support frame; 1552, second ankle training assembly; 15521, connecting part; 15522, third driving wheel; 15523, third guide wheel; 1553, third ankle training assembly; 15531, fourth driving wheel; 15532, fourth guide wheel; 156, pedal; 2, water tank; 3, control platform; 31, table; 32, control device; 33, wearing seat; 4, rotating mechanism; 41, rotation hole; 42, rotating support rod; 43, fixing rod; 44, support inclined rod; 5, lower-limb support mechanism; 51, support sleeve; 52, telescopic rod; 53, groove; 10, Bowden cable assembly; 10-1, knee Bowden cable assembly; 10-2, first ankle Bowden cable assembly; 10-3, second ankle Bowden cable assembly; and 10-4, third ankle Bowden cable assembly.

DETAILED DESCRIPTION OF EMBODIMENTS

Technical solutions of the present disclosure will be described in detail below with reference to the embodiments and accompanying drawings. Obviously, presented in the accompany drawings are merely some embodiments of the present disclosure, which are not intended to limit the disclosure.

Embodiment 1

Referring to an embodiment shown in FIGS. 1-7, a training mechanism 1 for water-based lower-limb rehabilitation includes a remote control motor box 11, a support plate 12, a sliding table-rod assembly 13, a hanging frame 14 and two leg training sub-mechanisms 15. The remote control motor box 11 is arranged at a portion of the wall of a water tank 2 which is not in contact with water, or arranged away from water. The support plate 12 is configured for patient's buttocks to lean on. The sliding table-rod assembly 13 is fixedly arranged on the support plate 12, and is located on a position corresponding to the patient's back. The hanging frame 14 is arranged at an end of the sliding table-rod assembly 13 away from the patient's body, and is configured to be allocated under the patient's arms. The leg training sub-mechanisms 15 are respectively and symmetrically arranged at two sides of the support plate 12, and is configured for training of patient's legs.

Each of the leg training sub-mechanisms 15 includes a hip joint training device 151, a knee training device 154 and an ankle training device 155. The hip joint training device 151, the knee training device 154 and the ankle training device 155 are connected to the remote control motor box 11 through a Bowden cable assembly 10, respectively.

The Bowden cable assembly 10 includes a driving wheel, two guide wheels matching the driving wheel and two Bowden cables. First ends of the two Bowden cables are connected to output shafts of two motors in the remote control motor box 11, respectively. A second end of one of the two first Bowden cables is configured to wind around one of the two first guide wheels to be fixed to a first side of the first driving wheel, and a second end of the other of the two first Bowden cables is configured to wind around the other of the two first guide wheels to be fixed to a second side of the first driving wheel. The two Bowden cables are configured to drive the driving wheel to rotate along a rotation axis thereof. The driving wheel includes a cable slot configured for cable passing and a fixing hole configured to fix the two Bowden cables. The cable slot is a semicircular slot arranged along a periphery of the driving wheel. Tow ends of the cable slot are each provided with a fixing hole to ensure the two Bowden cables are kept in the cable slot while driving the driving wheel. It should be noted that the two Bowden cables are respectively wound on the corresponding guide wheels from the outside, and then fixed at the fixing holes at two sides of the driving wheel. A side where the Bowden cable enters the guide wheels is located at the same side as a fixing side of the driving wheel, ensuring that the Bowden cables are stable during use and there is no interference between them.

This embodiment is described with reference to orientations (including front, back, left, right, top and bottom) in which the training mechanism is worn.

The power is transmitted to the training mechanism 1 through the Bowden cable assembly 10. The first ends of the two Bowden cable are respectively connected to the output shafts of the two motors, and the second ends thereof are wound around the two guide wheels and are respectively fixed to two sides of the driving wheel. The Bowden cables are configured to drive the driving wheel to rotate, so as to perform six-degree-of-freedom (6-DOF) lower-limb rehabilitation. It not only overcomes the underactuation of the rehabilitation mechanism in the complex fluid, but also effectively enhances the sensitivity of the robot in the presence of interference to the power source and power transmission in a complex fluid environment.

In this embodiment, the hip joint training device 151 includes a mounting plate 1511, an adjustable thigh plate 152, a first telescopic guide rod 1513 and a second telescopic guide rod 1514. The mounting plate 1511 is clampedly arranged at a lower end surface of the support plate 12. The adjustable thigh plate 152 is rotatably arranged on the mounting plate 1511 through a Hooke hinge 1512. An end (fixed end) of the first telescopic guide rod 1513 is rotatably arranged at an outer side of the adjustable thigh plate 152, and an end of the second telescopic guide rod 1514 is rotatably arranged at a rear side of the adjustable thigh plate 152. The adjustable thigh plate 152, the first telescopic guide rod 1513 and the second telescopic guide rod 1514 are rotatably connected to the mounting plate 1511 through a Hooke hinge 1512, respectively. The fixed end of the first telescopic guide rod 1513 is rotatably arranged at the outer side of the adjustable thigh plate 152, such that the first telescopic guide rod 1513 can drive the abduction and adduction of the adjustable thigh plate 152 by means of the extension and retraction, thereby realizing the abduction and adduction training of a hip joint. The fixed end of the second telescopic guide rod 1514 is rotatably arranged at the rear side of the adjustable thigh plate 152, such that based on the coordination of the second telescopic guide rod 1514 and the first telescopic guide rod 1513, the rotation training of the hip joint can be performed.

The adjustable thigh plate 152 includes a thigh fixing plate 1521, a thigh sliding plate 1522 and a fastening knob 1523. The thigh fixing plate 1521 is rotatably mounted at the mounting plate 1511. The thigh sliding plate 1522 is slidably connected to the thigh fixing plate 1521 in the vertical direction. The fastening knob 1523 is configured to fix the thigh fixing plate 1521 and the thigh sliding plate 1522. The thigh sliding plate 1522 can be slidden to adjust a distance between the thigh sliding plate 1522 and the thigh fixing plate 1521 according to the patient's height and thigh length. A copper bar is arranged on the thigh sliding plate 1522 for sliding of the thigh fixing plate 1521 and the thigh sliding plate 1522. Alternatively, the distance can also be adjusted by using a slide rail and a slide block, and the adjustment way is not limited herein.

The knee training device 154 includes a first driving wheel 1541 and two first guide wheels 1542. The first driving wheel 1541 is arranged on the adjustable thigh plate 152. The two first guide wheels 1542 are arranged side by side on the adjustable thigh plate 152 and above the first driving wheel 1541. The first driving wheel 1541 is coaxially arranged with the adjustable shank plate 153. Two sides of the first driving wheel 1541 are each fixedly provided with a first Bowden cable. The two first Bowden cables are crosswise wound around the two first guide wheels 1542, and respectively connected to output ends of two first driving motors.

Figure 4:
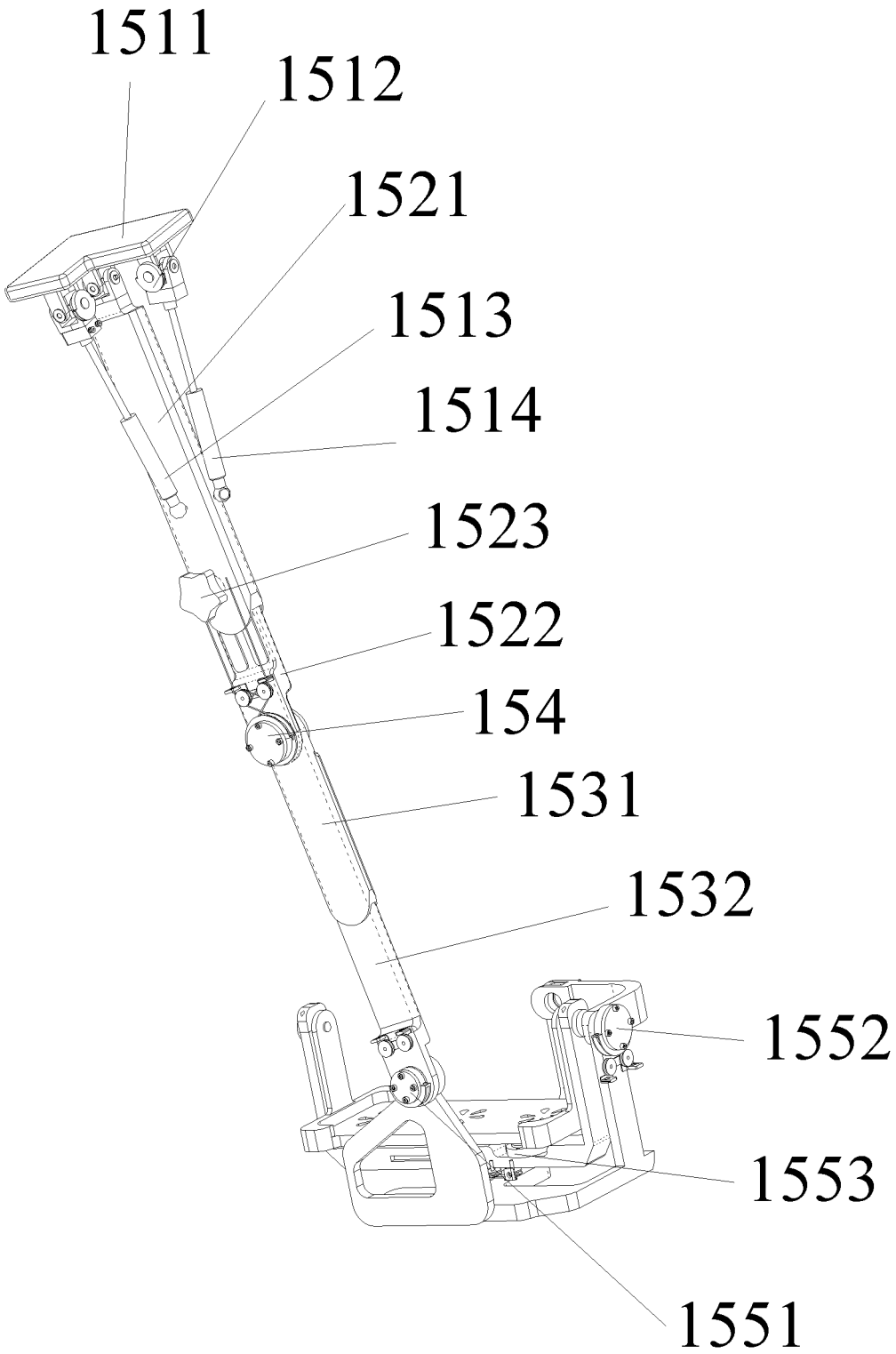
FIG. 4 schematically depicts a structure of a leg training sub-mechanism according to Embodiment 1 of the present disclosure.
Figure 5:
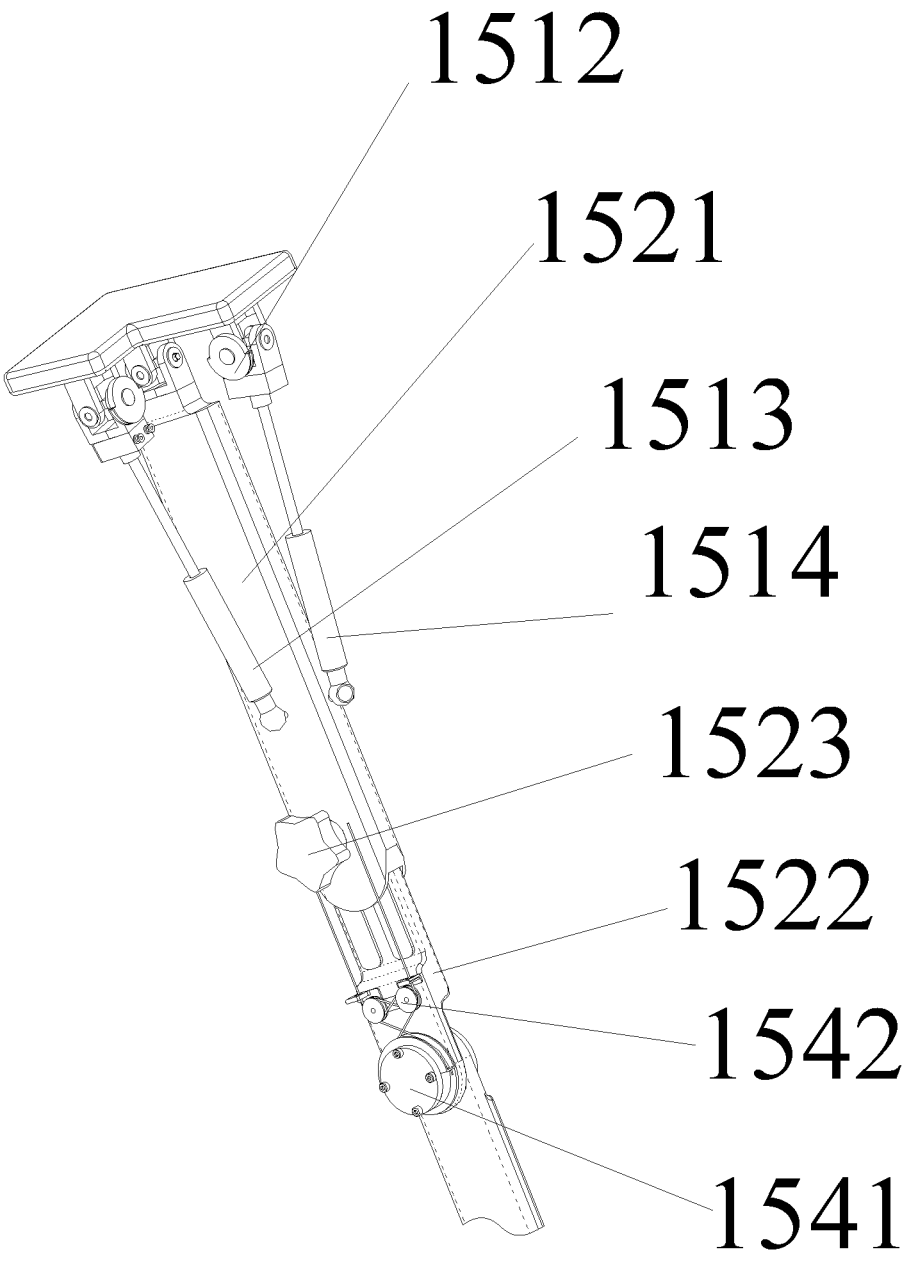
FIG. 5 structurally depicts a hip joint training device and a knee training device according to Embodiment 1 of the present disclosure.
Figure 6:
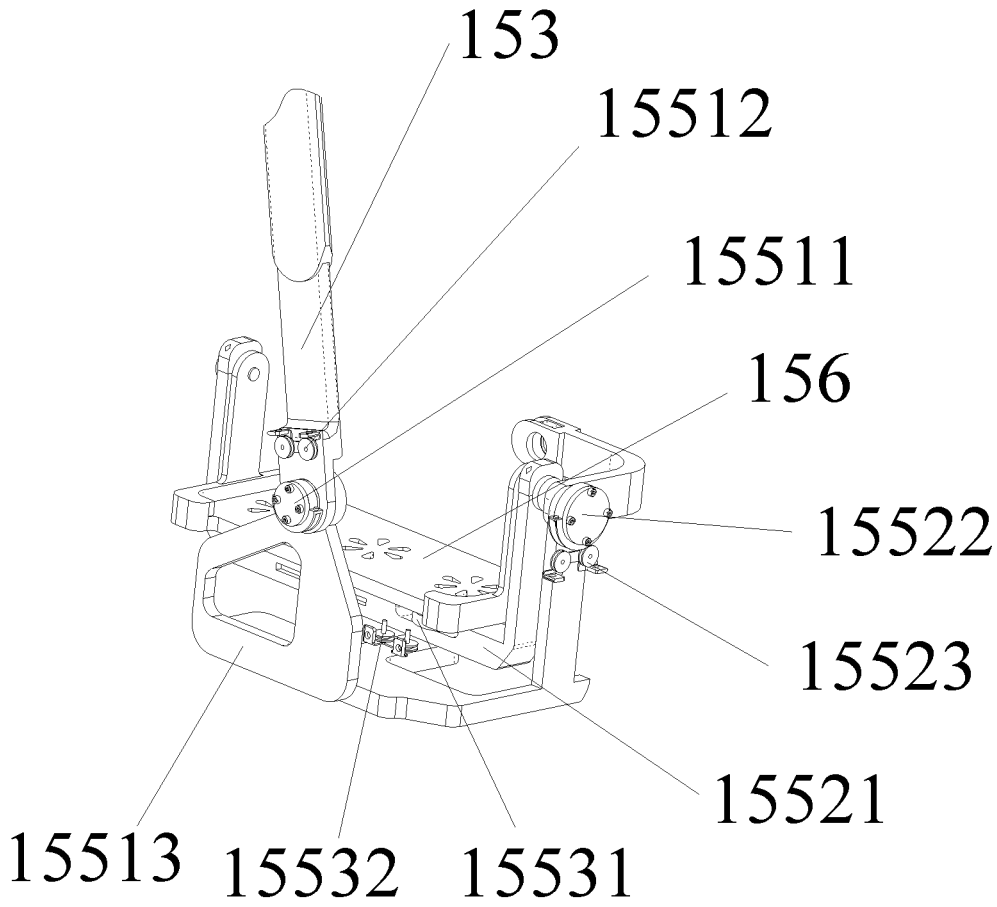
FIG. 6 structurally depicts an ankle training device according to Embodiment 1 of the present disclosure.

Referring to FIGS. 4 and 6, the ankle training device 155 includes a first ankle training assembly 1551, a second ankle training assembly 1552 and a third ankle training assembly 1553. The first ankle training assembly 1551 is configured for ankle flexion and extension. The second ankle training assembly 1552 is configured for ankle inversion and eversion. The third ankle training assembly 1553 is configured for ankle abduction and adduction. The first ankle training assembly 1551 includes a second driving wheel 15511, two second guide wheels 15512 and an ankle support frame 15513. The second driving wheel 15511 is arranged on the adjustable shank plate 153. The two second guide wheels 15512 are arranged side by side on the adjustable shank plate 153 and above the second driving wheel 15511. The ankle support frame 15513 is connected to the pedal 156. The ankle support frame 15513 is coaxially arranged with the second driving wheel 15511. Two sides of the second driving wheel 15511 are each fixedly provided with a second Bowden cable. The two second Bowden cables are crosswise wound around the two second guide wheels 15512, and connected to output ends of two second driving motors, respectively. In this embodiment, the pedal 156 has a hollowed-out structure, which reduces the weight and weakens the resistance of water.

The second ankle training assembly 1552 includes a connecting part 15521, a third driving wheel 15522 and two third guide wheels 15523. The connecting part 15521 is rotatably arranged on the ankle support frame 15513. The third driving wheel 15522 is arranged on a vertical bar of the ankle support frame 15513. The two third guide wheels 15523 are arranged side by side on the vertical bar and below the third driving wheel 15522. The connecting part 15521 is coaxially arranged with the third driving wheel 15522. Two sides of the third driving wheel 15522 are each fixedly provided with a third Bowden cable. The two third Bowden cables are crosswise wound around the two third guide wheels 15523, and are connected to output ends of two third driving motors, respectively.

The third ankle training assembly 1553 includes a fourth driving wheel 15531 and two fourth guide wheels 15532. The fourth driving wheel 15531 is arranged on a bottom plate of the connecting part 15521. The two fourth guide wheels 15532 are arranged side by side on a bottom plate of the ankle support frame 15513 and outside the fourth driving wheel 15531. The fourth driving wheel 15531 is coaxially arranged with the connecting part 15521. Two sides of the fourth driving wheel 15531 are each fixedly provided with a fourth Bowden cable. The two fourth Bowden cables are crosswise wound around the two fourth guide wheels 15532, and are connected to output ends of two fourth driving motors, respectively.

In this embodiment, the adjustable shank plate 153 includes a shank fixing plate 1531 and a shank sliding plate 1532. The shank fixing plate 1531 is connected to the knee training device 154. The shank sliding plate 1532 is slidably connected to the shank fixing plate 1531. The second driving wheel 15511 and the two second guide wheels 15512 are arranged on the shank sliding plate 1532. A first friction copper sheet is arranged between the thigh sliding plate 1522 and the thigh fixing plate 1521, and a second friction copper sheet is arranged between the shank sliding plate 1532 and the shank fixing plate 1531. A distance between the thigh sliding plate 1522 and the thigh fixing plate 1521 and a distance between the shank sliding plate 1532 and the shank fixing plate 1531 can be adjusted for patients varying in thigh and shank length.

Figure 7:
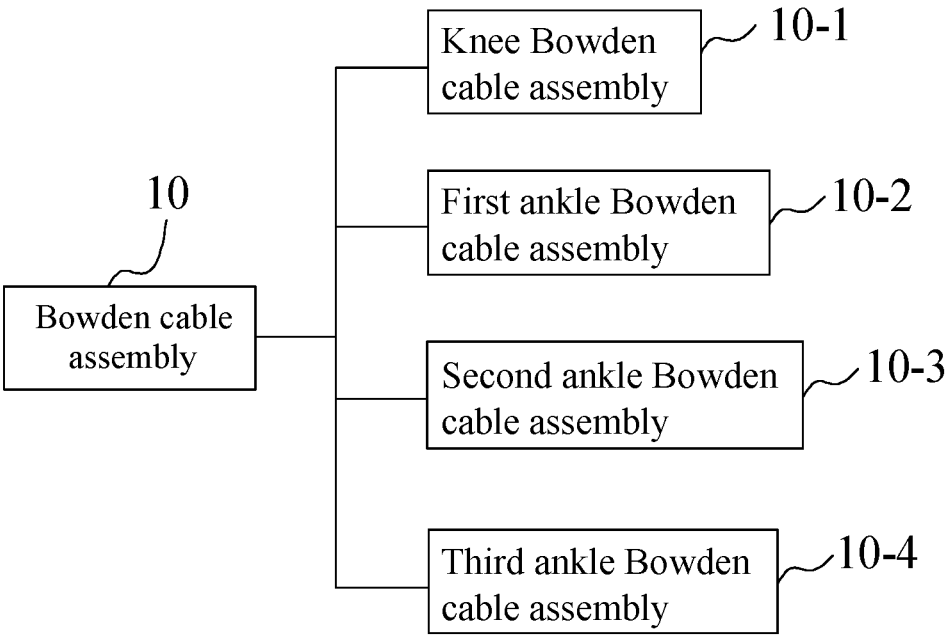
FIG. 7 shows classification of a Bowden cable assembly according to Embodiment 1 of the present disclosure.

Referring to FIG. 7, the Bowden cable assembly 10 includes a knee Bowden cable assembly 10-1, a first ankle Bowden cable assembly 10-2, a second ankle Bowden cable assembly 10-3 and a third ankle Bowden cable assembly 10-4.

The knee Bowden cable assembly 10-1 is configured for knee flexion and extension training. The first driving wheel 1541 of the knee Bowden cable assembly 10-1 is arranged on the thigh sliding plate 1522, and is coaxially arranged with to the shank fixing plate 1531. A first knee guide wheel and a second knee guide wheel are arranged side by side on the thigh sliding plate 1522 and above the first driving wheel 1541. One of the two first Bowden cables is wound from an outside of the first knee guide wheel, and passes through the second knee guide wheel to be fixed on a fixing hole of the first driving wheel 1541. The other of the two first Bowden cables is wound from an outside of the second knee guide wheel, and passes through the first knee guide wheel to be fixed on another fixing hole of the first driving wheel 1541. A side where the first Bowden cable enters the two knee guide wheels is the same as a fixed side on the first driving wheel 1541. The two first Bowden cables are respectively driven by two motors to move asynchronously. The first Bowden cables are configured to pull the first driving wheel 1541 to rotate within a preset angle range. Since the shank fixing plate 1531 is coaxially arranged with the first driving wheel 1541, the shank fixing plate 1531 is driven to rotate back and forth, so as to realize the knee flexion and extension training.

The first ankle Bowden cable assembly 10-2 is configured for ankle flexion and extension training. The second driving wheel 15511 of the first ankle Bowden cable assembly 10-2 is arranged on the shank sliding plate 1532, and is coaxially arranged with the ankle support frame 15513. A first ankle guide wheel and a second ankle guide wheel are arranged side by side on the shank sliding plate 1532, which is located above the second driving wheel 15511. One of the two second Bowden cables is wound from an outside of the first ankle guide wheel, and passes through the second ankle guide wheel. The other of the two second Bowden cables is wound from an outside of the second ankle guide wheel, and passes through the first ankle guide wheel. Then the two second Bowden cables are crosswise fixed to two fixing holes of the second driving wheel 15511, respectively. The two second Bowden cables are driven by two motors to move asynchronously. The second Bowden cables pull the second driving wheel 15511 to rotate within a preset angle range. Since the second driving wheel 15511 is coaxially arranged with the ankle support frame 15513, the ankle support frame 15513 is driven to rotate back and forth, so as to realize the ankle flexion and extension training.

The second ankle Bowden cable assembly 10-3 is configured for ankle inversion and eversion training. The third driving wheel 15522 of the second ankle Bowden cable assembly 10-3 is arranged on the vertical bar of the ankle support frame 15513, and is coaxially arranged with the pedal 156. A third ankle guide wheel and a fourth ankle guide wheel are arranged side by side on the vertical bar of the ankle support frame 15513 and below the third driving wheel 15522. The two third Bowden cables are wound in the same manner as the second Bowden cables of the first ankle Bowden cable assembly 10-2. Two corresponding motors drive the third Bowden cables to move asynchronously, and then the third Bowden cables pull the third driving wheel 15522 to rotate within a preset angle range. Since the pedal 156 is coaxially arranged with the third driving wheel 15522, the pedal 156 is driven to swing left and right, so as to realize the ankle inversion and eversion training.

The third ankle Bowden cable assembly 10-4 is configured for ankle abduction and adduction training. The fourth driving wheel 15531 of the third ankle Bowden cable assembly 10-4 is arranged on the bottom plate of the connecting part 15521, and is coaxially arranged with the connecting part 15521. A fifth ankle guide wheel and a sixth ankle guide wheel are arranged on the bottom plate of the ankle support frame 15513, which is below the connecting part 15521. Similarly, two motors are used to drive the two fourth Bowden cables to drive the fourth driving wheel 15531 to rotate, so as to drive the connecting part 15521 to rotate around an axis of the fourth driving wheel 15531, realizing the ankle abduction and adduction training. The axis of the fourth driving wheel 15531 is perpendicular to the bottom plate of the ankle support frame 15513.

The knee Bowden cable assembly 10-1, the first ankle Bowden cable assembly 10-2, the second ankle Bowden cable assembly 10-3 and the third ankle Bowden cable assembly 10-4 can perform four-degree-of-freedom training, including knee flexion and extension, ankle flexion and extension, ankle inversion and eversion and ankle abduction and adduction, fully training the patient's knee and ankle. Furthermore, rotating angles of the first driving wheel 1541, the second driving wheel 15511, the third driving wheel 15522 and the fourth driving wheel 15531 can be adjusted according to actual requirements, allowing for strong adaptability and applicability.

Embodiment 2

Provided is a robot for water-based lower-limb rehabilitation using the training mechanism described in Embodiment 1.

Figure 8:
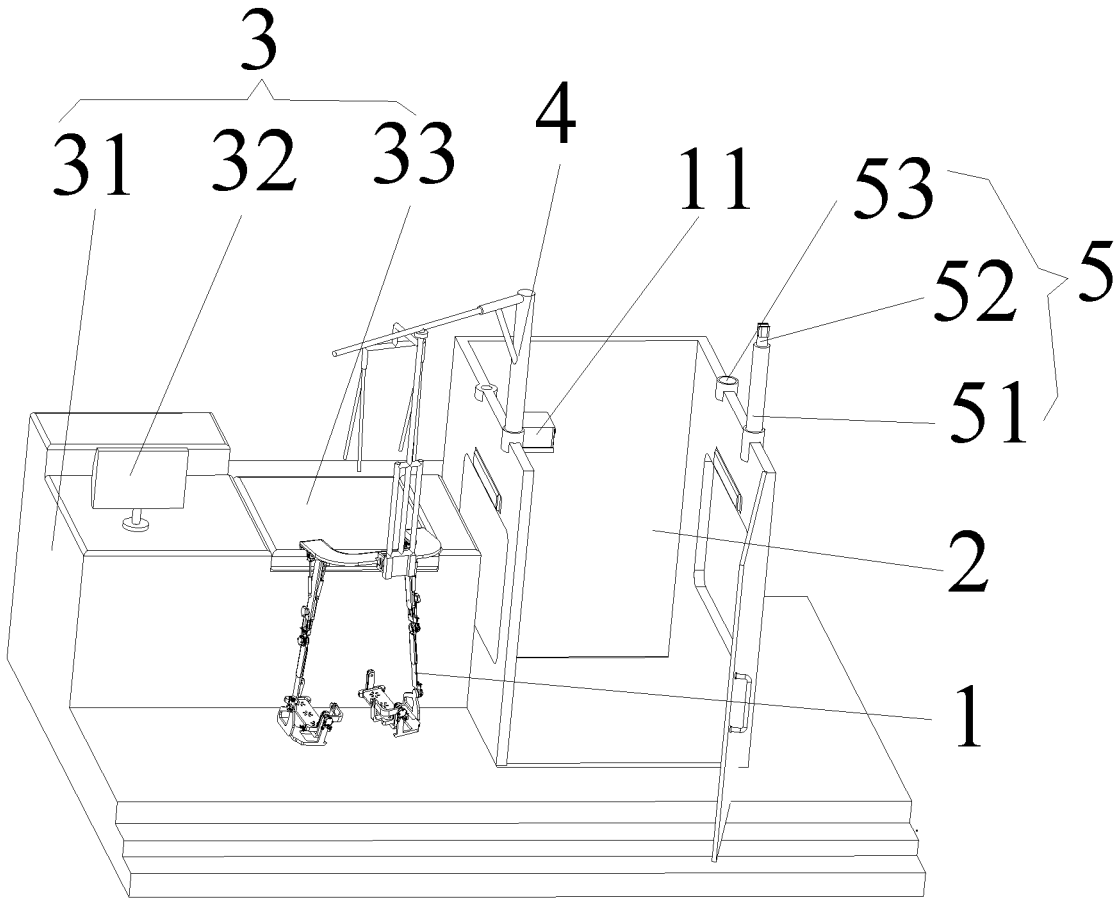
FIG. 8 is a perspective view of a robot according to Embodiment 2 of the present disclosure in a wearing state.
Figure 9:
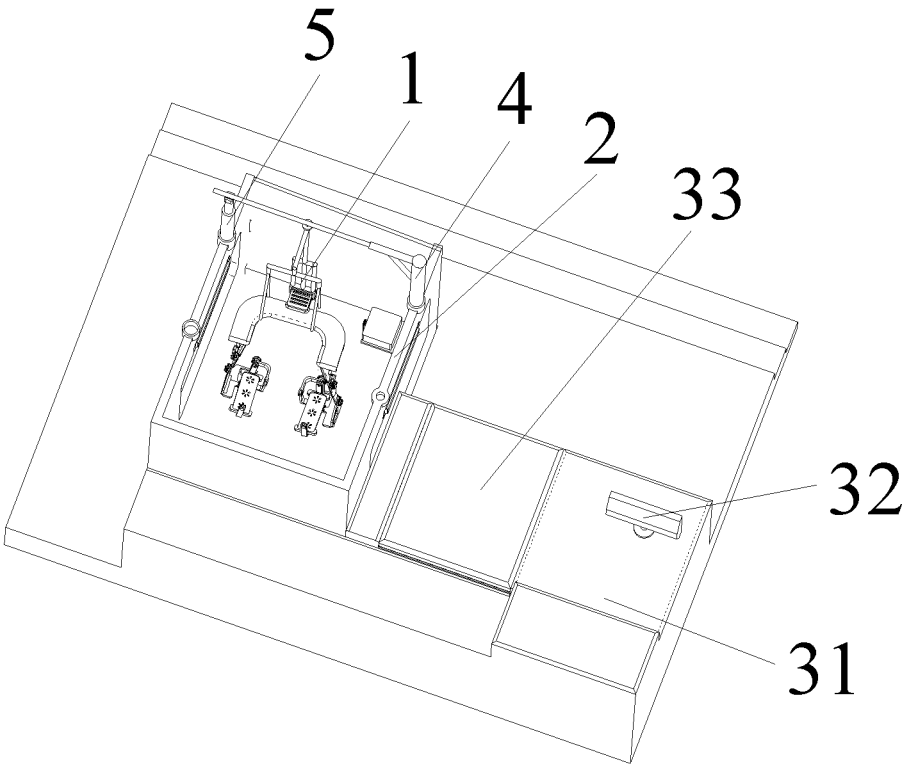
FIG. 9 is a perspective view of the robot according to Embodiment 2 of the present disclosure in a training state.
Figure 10:
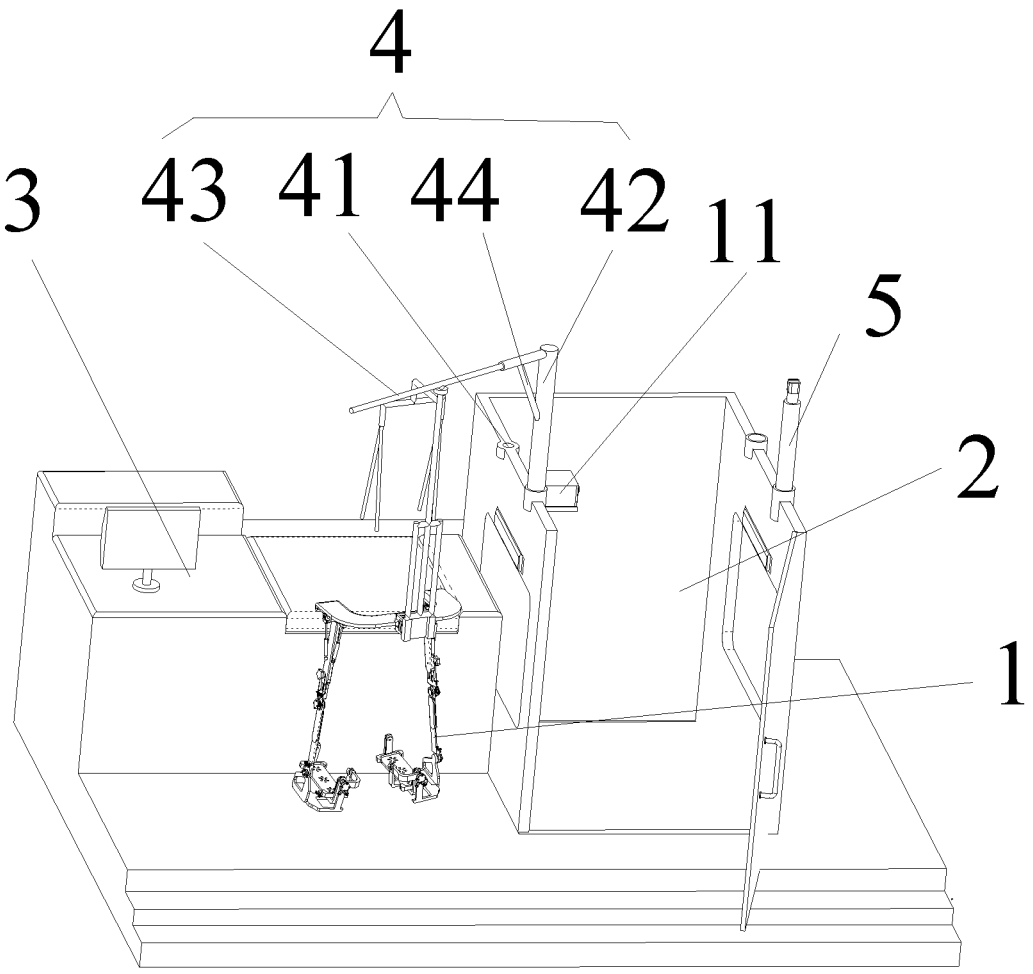
FIG. 10 structurally depicts a rotating mechanism according to Embodiment 2 of the present disclosure.

Referring to FIGS. 8-10, the robot includes the training mechanism 1, a water tank 2 for accommodating water and a control platform 3 for controlling the training mechanism 1.

The training mechanism 1 is rotatably connected to an upper end of the water tank 2 through a rotating mechanism 4. When the patient wears the training mechanism 1, the training mechanism 1 is rotated to an outside of the water tank 2. When the patient is subjected to rehabilitation training, the training mechanism 1 is rotated to an inside of the water tank 2. The remote control motor box 11 is fixedly arranged on an inner wall of the water tank 2 and is not in contact with the water inside the water tank 2.

The rotating mechanism 4 includes a rotation hole 41, a rotating support rod 42 and a fixing rod 43. The rotation hole 41 is provided at the upper end of the water tank 2. The rotating support rod 42 is rotatably arranged at the rotating hole 41. The fixing rod 43 is arranged on the rotating support rod 42. The fixing rod 43 is perpendicular to a main rod body of the rotating support rod 42. The sliding table-rod assembly 13 is rotatably connected to the fixing rod 43. The sliding table-rod assembly 13 is parallel to the main rod body of the rotating support rod 42. The control platform 31 includes a table 31, a control device 32 and a wearing seat 33. The control device 32 is arranged on the table 31, and is configured to be operated by a medical worker for control.

The wearing seat 33 is arranged at an upper end surface of the table 31, and is provided for the patient to sit on during wearing.

The sliding table-rod assembly 13 is capable of rotating 360° around its axis with respect to the fixing rod 43. When the patient needs to wear the training mechanism 1, the medical worker operates the control device 3 to rotate the training mechanism 1 around an axis of the rotating support rod 42 to the outside of the water tank 2, and rotate the training mechanism 1 around an axis of the sliding table-rod assembly 13 at a preset angle, such that a backrest faces towards a direction away from the wearing seat 33. Accordingly, the patient can directly walk into the water tank 2 by himself after wearing the training mechanism 1, instead of backing into the water tank 2 in a reverse direction.

The training mechanism 1 is rotatably mounted at an upper end of the water tank 2, such that they can rotate freely in a preset angle range. When the patient wears the training mechanism 1, the training mechanism 1 is rotated to the outside of the water tank 2. When the patient needs to be trained, the training mechanism 1 is rotated to the inside of the water tank 2. The medical worker does not require to get into the water to help the patient to wear the training mechanism 1. In addition, the training mechanism 1 can be adjusted at the outside of the water tank according to the patient's height, facilitating the wearing process. By means of the rotating mechanism 4, the medical worker does not require to get into the water to help the patient to wear the training mechanism 1, exhibiting a promising application prospect.

In this embodiment, the robot further includes a lower-limb support mechanism 5. The lower-limb support mechanism 5 is arranged at the upper end of the water tank 2, and is opposite to the rotation hole 41. The lower-limb support mechanism 5 is configured to support an end of the fixing rod 43 away from the rotating support rod 42. The lower-limb support mechanism 5 includes a support sleeve 51 and a telescopic rod 52. The support sleeve 51 is fixedly arranged at the upper side of the water tank 2. The telescopic rod 52 is sleevedly provided inside the support sleeve 51. An end of the telescopic rod 52 away from the water tank 2 is provided with a groove 53. The groove 53 is configured to receive the fixing rod 43. A height of the telescopic rod 52 inside the support sleeve 51 is adjustable.

The medical worker can lower the telescopic rod 52 through the control platform 3, so as to prevent interference between the fixing rod 43 and the telescopic rod 52 when the patient with the training mechanism 1 enters the water tank 2. After the patient has reached a designed position, the height of the telescopic rod 52 can be adjusted to clamp the fixing rod 43 in the groove 53, which ensures the stability during rehabilitation training, and preventing a secondary injury caused by movement of the training mechanism.

Regarding the robot designed herein, the power source is arranged outside the water, and the power is supplied to the underwater training mechanism through a Bowden cable assembly. Therefore, it is not required to perform waterproofing treatment on the power source or add an additional waterproofing device. Moreover, the robot can realize the six-degree-of-freedom (6-DOF) training including hip abduction and adduction, hip flexion and extension, knee flexion and extension, ankle flexion and extension, ankle inversion and eversion and ankle abduction and adduction. Therefore, the robot has excellent flexibility and low cost. Moreover, The robot provided herein can be used to independently train patient's hip, knee or ankle, and can also realize the synergistic and coordinated training of multiple joints, allowing for improved man-machine compatibility and comfortability.

The embodiments provided above are merely illustrative, and are not intended to limit the scope of the present disclosure. It should be understood that changes and variations made by those skilled in the art without departing from the spirit and scope of the disclosure shall fall within the scope of the present disclosure defined by the appended claims.

What is claimed is:

1. A training mechanism for water-based lower-limb rehabilitation, comprising:

a remote control motor box;

a support plate;

a sliding table-rod assembly;

a hanging frame; and two leg training sub-mechanisms;

wherein the remote control motor box is arranged at a portion of a wall of a water tank which is not in contact with water, or arranged at a platform outside the water; the support plate is configured for buttocks of a patient to lean on; the sliding table-rod assembly is fixedly arranged at a position on the support plate corresponding to a back of the patient; the hanging frame is arranged at an end of the sliding table-rod assembly away from the patient, and is configured to be located under patient's arms; and the two leg training sub-mechanisms are symmetrically arranged at two sides of the support plate, and are configured for training of patient's legs;

each of the two leg training sub-mechanisms comprises a hip joint training device, an adjustable thigh plate, an adjustable shank plate, a knee training device, an ankle training device and a pedal; and the hip joint training device, the knee training device and the ankle training device are in power connection with the remote motor control box through a Bowden cable assembly, respectively; and the Bowden cable assembly comprises a first driving wheel, two first guide wheels matching the first driving wheel, and two first Bowden cables; first ends of the two first Bowden cables are connected to output shafts of two first motors in the remote control motor box, respectively; and a second end of one of the two first Bowden cables is configured to wind around one of the two first guide wheels to be fixed to a first side of the first driving wheel, and a second end of the other of the two first Bowden cables is configured to wind around the other of the two first guide wheels to be fixed to a second side of the first driving wheel;

and the two first Bowden cables are configured to drive the first driving wheel to rotate along a rotation axis of the first driving wheel.

2. The training mechanism of claim 1, wherein the hip joint training device further comprises a mounting plate, the adjustable thigh plate, a first telescopic guide rod and a second telescopic guide rod;

the mounting plate is clampedly arranged at a lower end surface of the support plate;

the adjustable thigh plate is rotatably arranged on the mounting plate through a Hooke hinge;

an end of the first telescopic guide rod is rotatably arranged at an outer side of the adjustable thigh plate; and an end of the second telescopic guide rod is rotatably arranged at a rear side of the adjustable thigh plate.

3. The training mechanism of claim 1, wherein the knee training device comprises a second driving wheel and two second guide wheels;

the second driving wheel is arranged on the adjustable thigh plate; the two second guide wheels are arranged in parallel on the adjustable thigh plate and above the second driving wheel; the second driving wheel is coaxial with the adjustable shank plate; a first side of the second driving wheel is fixedly provided with one of two second Bowden cables, and a second side of the second driving wheel is fixedly provided with the other of the two second Bowden cables; and the two second Bowden cables are configured to crosswise wind around the two second guide wheels, and connected to output ends of the two first motors, respectively.

4. The training mechanism of claim 3, wherein the adjustable thigh plate comprises a thigh fixing plate, a thigh sliding plate and a fastening knob;

the thigh fixing plate is rotatably mounted at the mounting plate; the thigh sliding plate is slidably connected to the thigh fixing plate along a vertical direction; and the fastening knob is configured to fix the thigh fixing plate and the thigh sliding plate; and the second driving wheel and the two second guide wheels are mounted on the thigh fixing plate.

5. The training mechanism of claim 1, wherein the ankle training device comprises a first ankle training assembly, a second ankle training assembly and a third ankle training assembly; the first ankle training assembly is configured for ankle flexion and extension; the second ankle training assembly is configured for ankle inversion and eversion; and the third ankle training assembly is configured for ankle abduction and adduction;

the first ankle training assembly comprises a second driving wheel, two second guide wheels and an ankle support frame; the second driving wheel is arranged on the adjustable shank plate; the two second guide wheels are arranged in parallel on the adjustable shank plate and above the second driving wheel; the ankle support frame is connected to the pedal; the ankle support frame is coaxial with the second driving wheel; a first side of the second driving wheel is fixedly provided with one of two second Bowden cables, and a second side of the second driving wheel is fixedly provided with the other of the two second Bowden cables; the two second Bowden cables are configured to crosswise wind around the two second guide wheels, and connected to output ends of two second motors, respectively;

the second ankle training assembly comprises a connecting part, a third driving wheel and two third guide wheels; the connecting part is rotatably arranged on the ankle support frame; the third driving wheel is arranged on a vertical bar of the ankle support frame; the two third guide wheels are arranged in parallel on the vertical bar of the ankle support frame and below the third driving wheel; the connecting part is coaxial with the third driving wheel; a first side of the third driving wheel is fixedly provided with one of two third Bowden cables, and a second side of the third driving wheel is fixedly provided with the other of the two third Bowden cables; the two third Bowden cables are configured to crosswise wind around the two third guide wheels, and are connected to output ends of two third motors, respectively; and the third ankle training assembly comprises a fourth driving wheel and two fourth guide wheels; the fourth driving wheel is arranged on a bottom plate of the connecting part; the two fourth guide wheels are arranged side by side on a bottom plate of the ankle support frame, and outside the fourth driving wheel; the fourth driving wheel is coaxial with the connecting part; a first side of the fourth driving wheel is fixedly provided with one of two fourth Bowden cables, and a second side of the fourth driving wheel is fixedly provided with the other of the two fourth Bowden cables; the two fourth Bowden cables are configured to crosswise wind around the two fourth guide wheels, and are connected to output ends of two fourth motors, respectively.

6. The training mechanism of claim 5, wherein the pedal is rotatably connected to a vertical plate of the connecting part.

7. The training mechanism of claim 5, wherein the adjustable shank plate comprises a shank fixing plate and a shank sliding plate;

the shank fixing plate is connected to the knee training device; and the shank sliding plate is slidably connected to the shank fixing plate; and the second driving wheel and the two second guide wheels are arranged on the shank sliding plate.

8. A robot for water-based lower-limb rehabilitation, comprising:

the training mechanism of claim 1;

the water tank; and a control platform;

wherein the water tank is configured to accommodate water; and the control platform is configured to control rehabilitation training;

the training mechanism is rotatably connected to an upper end of the water tank through a rotating mechanism; the training mechanism is configured to rotate to an outside of the water tank when the patient is allowed to wear the training mechanism, and to rotate to an inside of the water tank to allow the patient to undergo rehabilitation training; and the remote control motor box is arranged on an inner wall of the water tank and is not in contact with the water inside the water tank.

9. The robot of claim 8, wherein the rotating mechanism comprises a rotation hole, a rotating support rod and a fixing rod;

the rotation hole is provided at the upper end of the water tank; the rotating support rod is rotatably arranged in the rotation hole; and the fixing rod is arranged on the rotating support rod; and the fixing rod is perpendicular to a main rod body of the rotating support rod; the sliding table-rod assembly is rotatably arranged on the fixing rod; and the sliding table-rod assembly is parallel to the main rod body of the rotating support rod.

10. The robot of claim 9, further comprising:

a lower-limb support mechanism;

wherein the lower-limb support mechanism is arranged at the upper end of the water tank, and is opposite to the rotation hole; and the lower-limb support mechanism is configured to support an end of the fixing rod away from the rotating support rod;

the lower-limb support mechanism comprises a support sleeve and a telescopic rod; the support sleeve is fixedly arranged at the upper end of the water tank; and the telescopic rod is sleevedly provided inside the support sleeve; and an end of the telescopic rod away from the water tank is provided with a groove; the groove is configured to receive the fixing rod; and a height of the telescopic rod inside the support sleeve is adjustable.

* * * * *